US006372091B2

(12) United States Patent
Wildfong et al.

(10) Patent No.: US 6,372,091 B2
(45) **Date of Patent: *Apr. 16, 2002**

(54) METHOD AND APPARATUS FOR FORMING A PAPER WEB

(75) Inventors: Vaughn J. Wildfong, Caledonia, IL (US); Jeffrey C. Irwin, Clinton; Jay A. Shands, Beloit, both of WI (US); Robert L. Clarke, Roscoe, IL (US)

(73) Assignees: Metso Paper, Inc., Helsinki (FI); Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/336,621

(22) Filed: Jun. 18, 1999

(51) Int. Cl.[7] ..... D21F 1/00

(52) U.S. Cl. ..... 162/301; 162/300; 162/351; 162/203

(58) Field of Search ..... 162/203, 301, 162/300, 351

(56) References Cited

U.S. PATENT DOCUMENTS

| | | | |
|---|---|---|---|
| 3,232,825 | A | 2/1966 | Robinson |
| 3,240,665 | A | 3/1966 | Robinson |
| 3,398,048 | A | 8/1968 | Latimer |
| 3,438,854 | A | 4/1969 | Means |

(List continued on next page.)

FOREIGN PATENT DOCUMENTS

| | | | |
|---|---|---|---|
| CA | 778131 | 2/1968 | |
| CA | 840109 | 4/1970 | |
| EP | 0 062 983 | A1 | 3/1982 |
| EP | 0 335 821 | A2 | 3/1989 |

OTHER PUBLICATIONS

PCT World Patent Publication, WO 91/02842, J.M. Voith GmbH.

Hydro–Flo Deckle™ Edge Control Systems & Hydro–Jet™ Formation Specialties.

Memorandum to J.L. Chance from K. Horita dated Sep. 6, 1995.

*Primary Examiner*—Christopher A. Fiorilla
*Assistant Examiner*—Mark Halpern
(74) *Attorney, Agent, or Firm*—Lathrop & Clark LLP

(57) ABSTRACT

A method and apparatus for beginning the formation of a paper web on a traveling forming wire, or between a pair of converging forming wires, includes a headbox on a papermaking machine for projecting a stock stream onto the forming wire, or between the forming wires over the porous face surface of a forming shoe. The forming wire or wires are looped to travel in a continuous path, and within at least one of the looped forming wires is the forming shoe, which is porous by way of grooves or openings over at least a portion of its face surface. The grooves are in the surface of the forming shoe which engages the inner surface of the looped forming wire to define a portion of the path of travel of the forming wire adjacent the headbox from which the stock stream is projected onto, or between, the forming wire(s). The grooves extend in the surface facing the forming wire from a point downstream of the leading edge in the nose portion of the face surface of forming shoe in the direction of forming wire travel. The grooves are angled at a small angle relative to the direction of forming wire travel. The grooves or openings receive water through the forming wire to gradually reduce the amount of water in the stock to control the initial stage of the formation of the nascent paper web on the forming wire over the forming shoe.

14 Claims, 7 Drawing Sheets

U.S. PATENT DOCUMENTS 3,726,758 A 4/1973 Parker et al.
3,846,233 A 11/1974 Kankaanpaa
3,884,756 A 5/1975 Gustafon
3,944,464 A 3/1976 Means
3,994,774 A 11/1976 Halme et al.
4,100,018 A 7/1978 Wahren et al.
4,216,056 A 8/1980 Nykopp
4,285,768 A 8/1981 Schiel
4,532,009 A 7/1985 Nickerson
4,609,435 A 9/1986 Tissari
4,714,521 A 12/1987 Fujiwara
4,734,164 A 3/1988 Irwin et al.
4,790,909 A 12/1988 Harwood
4,894,120 A 1/1990 North
5,019,214 A 5/1991 Meinecke et al.
5,074,966 A 12/1991 Koivuranta
5,201,999 A 4/1993 Field et al.
5,225,042 A 7/1993 Eaton et al.
5,225,043 A 7/1993 Braun et al.
5,248,392 A 9/1993 Bando et al.
5,259,929 A 11/1993 Bubik et al.
5,480,513 A 1/1996 Niskanen et al.
5,517,714 A 5/1996 Kotitschke
5,562,807 A 10/1996 Baluha
5,582,688 A * 12/1996 Bando et al. ..... 162/301
5,718,805 A 2/1998 Egelhof et al.
5,730,841 A 3/1998 Wanke
5,972,168 A * 10/1999 Egelhof ..... 162/203

* cited by examiner

METHOD AND APPARATUS FOR FORMING A PAPER WEB

BACKGROUND OF THE INVENTION

1. Field of the Invention

This invention relates to the formation of a paper web from an aqueous slurry of wood pulp fibers, commonly called stock. More particularly, this invention relates to a method and apparatus for the high-speed formation of paper at the initial stage of such formation by projecting a stock stream against (between) a traveling forming wire(s) at a location over the porous surface of a forming shoe. Still more particularly, this invention relates to such formation of a paper web utilizing a forming shoe wherein the porous surface comprises grooves in the face of the forming shoe supporting the forming wire, which grooves extend substantially in the direction of forming wire travel, but at a small angle thereto. In another preferred embodiment, the porous surface comprises a plurality of openings.

2. Description of the Prior Art

In the making of paper from an aqueous slurry of wood pulp fibers, whether the initial formation is done over a single forming wire, such as in a Fourdrinier forming section, or in a two forming wire machine, such as a so-called gap former, wherein a pair of looped, opposed forming wires are directed into a converging, co-running path of travel over a stock stream which is projected by a headbox between the forming wires, the water in the stock is drained through the forming wire(s) to begin the formation of the paper web by leaving the wood pulp fibers randomly distributed on the forming wire, or between the co-running forming wires.

Depending on the type of paper or paper board to be manufactured, different types of stock are used. The rate at which water can be removed from different stocks to produce a quality paper product is a function of many factors, such as, for example, the paper product, the desired caliper of the paper product to be made, the design speed of the papermaking machine, and the desired levels of fines, fibers and fillers within the final paper product.

The use of forming shoes to guide one or two forming wires in the forming section of a papermaking machine is known in the art. Also known is the use of a so-called forming roll, which is sometimes constructed of a foraminous cover for receiving water passing through the forming wire and into the forming roll from the stock carried on the outer surface of the forming wire.

It is further known to use a forming shoe having grooves in the surface thereof, which grooves begin downstream of the leading edge of the forming shoe and extending at a small angle to the machine direction (i.e., the direction of travel of the paper web through the papermaking machine).

Within the forming section of a papermaking machine, there is known various types of apparatus, such as foil blades, vacuum boxes, turning rolls, suction rolls, and open surface rolls which have been used in various configurations and sequences in order to seek optimization of the rate, time and location of removing water in the formation of the nascent paper web. Papermaking is still part art and part science in that simply removing water as fast as possible does not produce a paper product of the highest quality. In other words, the production of a high quality paper product at high speeds, such as, for example, about 6,000 ft/min. (2,000 m/min) is a function of the rate of water removal, the manner in which water is removed, the duration of water removal, and the location at which water is removed from the stock on the forming wire, or between the forming wires.

In the past, when papermaking machine speeds were lower, such as, for example, 3,000–4,000 ft/min. (914–1219 m/min), the relative application of the aforementioned factors might be different to produce the desired quality in the paper product. Further, as with most processes, when it is desired to maintain, or improve, quality of a product while producing the product at faster rates, unanticipated problems are often encountered which result in either the rate of production having to be lowered in order to maintain or attain the desired quality, or the desired quality having to be sacrificed in order to attain a higher rate of production.

Prior blade elements, or foils, for forming shoes, whether the forming shoe is curved or flat in surface configuration, sometimes contain a plurality of slots formed between a plurality of blade elements extending longitudinally along the length of the blade elements. The slots in turn define leading edges on the blade elements which are arrayed in the cross-machine direction perpendicular to the direction of forming wire travel. Such an arrangement works well. The stock stream is projected against a forming wire over the leading edge of the forming shoe/foil such that a portion of the stock stream passes through the forming wire and beneath the shoe/foil. Each foil, blade element, or forming shoe is either open at the bottom to atmospheric pressure, or they are connected to a source of sub-atmospheric pressure to enhance the dewatering process by urging the water into the slots between adjacent foils or blade elements defining the faces, or top surfaces, of the foil or forming shoe.

However, as papermaking machine speeds increase to more economically manufacture the paper product, new phenomena regarding the runnability of the papermaking apparatus as well as the appearance and internal structure of the paper product produced begin to appear. Most of these changes are not desirable.

These phenomena can take various forms, such as undesirable distribution of fines and fillers in the surface or interior of the paper product, and the first pass retention or retention of fine material would decrease. These variations and imperfections are deleterious to the paper product and affect its saleability.

SUMMARY OF THE INVENTION

The above-mentioned imperfections, deficiencies and factors affecting the production and quality of a paper product caused by a forming shoe or foil section in the forming section of the papermaking machine have been obviated or mitigated by this invention.

In this invention, a forming shoe is used which has a porous surface. In a preferred embodiment, the porous surface can take the form of a plurality of parallel grooves formed in a portion of its face surface. In another preferred embodiment, the porous surface can take the form of a plurality of small openings, such as drilled holes, slots, honeycomb, or the like.

The forming shoe has a curved, leading nose surface and the grooves, in a preferred embodiment, are initially formed in the downstream portion of the nose with their beginning (i.e., the bottom surface of the groove) smoothly contiguous therewith. The grooves extend downstream at a small angle to the machine direction, which is the direction of forming wire travel. The depth of the grooves also gradually increases from the point of their initial intersection with the nose surface on the forming shoe.

In a preferred embodiment, each groove does not extend through the forming shoe to be exposed to atmospheric pressure beneath the forming shoe. Further, in a preferred embodiment, each groove extends at its small angle to the machine direction for a distance such that the beginning of the groove, in the machine direction, overlaps the end of at least one adjacent groove such that a given point of the forming wire traveling in the machine direction passes over a portion of at least two grooves in its path of travel over the forming shoe.

Further in a preferred embodiment, the radius of curvature of the porous forming shoe is a compound radius, such as, for example, on a forming shoe having a face surface extending about 18 inches in the machine direction, a radius of up to about 60 inches, preferably about 30–40 inches, for the first four inches of length in the machine direction, and a radius of about 100–200 inches for the next ten to twelve inches downstream in the machine direction, and a radius of about 10 inches for the last two to four inches of face surface length. However, it is contemplated, and intended to be within the scope of this invention, that the compound radius could comprise two radii and two separate blades in the shoe, each blade being about seven inches long in the machine direction. There would be a small slot between the blades such as, for example, about one inch, or less. The radii would then be, for example, a 40 inch radius for the first four inches of face surface, and a radius of about 100–200 inches for the remainder of the face surface in a forming shoe having a total length of about 15 inches.

It is also contemplated that the radius of curvature change continuously, in the manner of a French curve, from the leading, or nose portion of the forming shoe, through the intermediate, or porous portion of the forming shoe, and through the trailing portion of the forming shoe, which may be porous or non-porous. This would be a continuously changing compound curve. The instant radius of curvature at any given location would be such that the rate of water removal at the point of stock stream impingement, and over the porous portion would be constant, or near constant, as desired.

Further, it is also contemplated that the curvature of the grooved forming shoe could comprise a simple curve for the nose portion with a substantially straight trailing surface, or a continuous curve. The straight railing surface configuration would probably only be used in a single forming wire application. The length of the straight surface would probably be no longer than about seven inches. For example, the radius of such a continuous curve for the face surface could range from about 25–60 inches for a face surface about eighteen inches in length. These are intended to be within the scope of the invention.

By not having the individual grooves extending substantially in the cross-machine direction, in conjunction with the radii described above, and with each location of the forming wire traveling in the machine direction, the stock carried on the outer surface of the forming wire passes relatively gently over a groove, in a dewatering action, since the groove co-extends in substantially the same direction for a relatively short period of time of forming wire travel, but which period of time is longer than the period of time at which the slot would pass under the stock if the slot was extending in the cross-machine direction. The machine direction nature of the grooves redirects the flow of the drained water less, which means less flow being forced back up into the web as the drained flow impacts the blade.

In the case of the face surface being porous by means of a plurality of openings, such as small holes, the small size of the individual openings, relative to the area of the face surface which does not contain small openings, provides the same benefit. As shown in FIG. 11, the slots are angled to avoid backflow, refluidization of the web, and a stripping of fine material.

Regardless of the contemplated configuration of the porous surface, the invention further embodies the concept of impinging the stock stream onto the curved face surface of the forming shoe over the porous surface and not over the leading edge of the forming shoe, as is done in the prior art.

In addition, the rapid pulsation in the stock on top of the forming wire in prior arrangements caused by the rapid alteration of the slots and the following land areas in foils, foil boxes or forming shoes is mitigated in this invention because a small area of stock, that is a small area of an aqueous slurry of wood pulp fibers, on the forming wire is exposed to the plurality of grooves or other means forming the porous surface for a somewhat longer period of time due to the ability of the porous surface to absorb the force of impingement of the stock stream by virtue of passing a portion of the water into the porous surface and thereby lessen the formation of any pulse. This pulse absorption takes the form of either the grooves extending at a small angle to the direction of machine travel such that the on-coming leading edge of the next successive blade element does not pass a particular line in the cross-machine direction at the same time, or the impinging stock being on the forming wire over openings in the porous surface.

This operation also functions to even out cross-machine paper web basis weight variations as well as mitigates pulsations in the stock passing over the face surface of the forming shoe. It helps to permit faster papermaking machine speeds while maintaining, or even improving, paper web formation.

Accordingly, it is a feature of this invention to provide a method and apparatus for improving the dewatering of stock in the forming section of a papermaking machine to form the nascent paper web in the early stage of paper formation when the headbox is discharging a stream of stock onto the forming wire over the porous forming shoe.

It is another feature of this invention to provide a method and apparatus for forming a paper web by use of a forming shoe having a porous surface.

It is another feature of this invention to provide a method and apparatus for forming a paper web by removing water from the stock by means of a forming shoe having a plurality of grooves extending at a small angle to the machine direction.

It is another feature of this invention to provide a method and apparatus for forming a forming shoe having a surface containing a plurality of small openings.

Yet another feature of this invention is to provide a method and apparatus for forming a paper web by use of a forming shoe having a porous surface which provides substantially constant water drainage in the downstream direction.

These, and other objects, features and advantages of the invention will become readily discernible to those skilled in the invention upon reading the description of the preferred embodiments in conjunction with the attached drawings.

DESCRIPTION OF THE PREFERRED EMBODIMENTS

Figure 1:
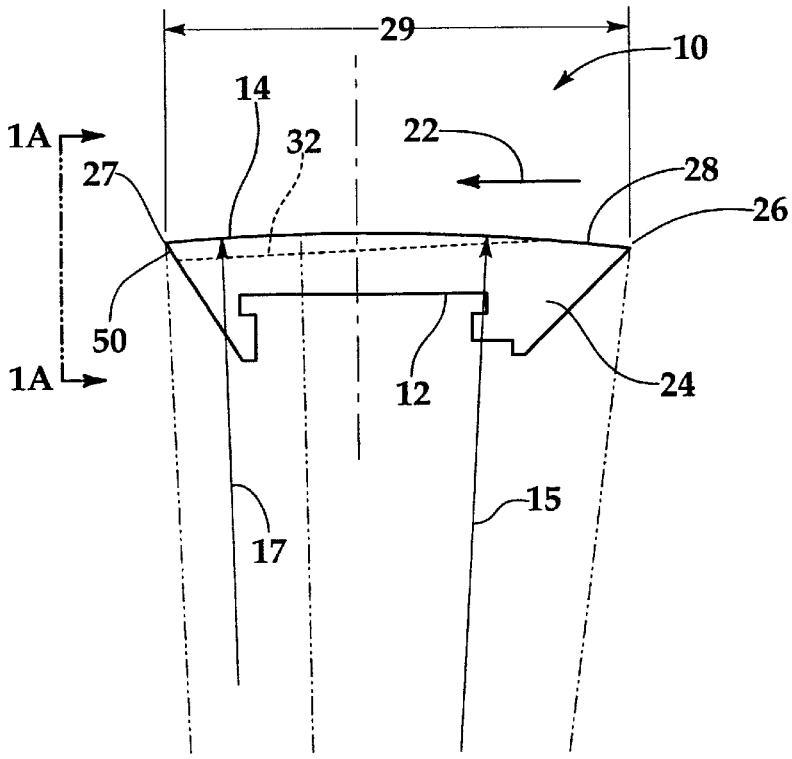
FIG. 1 is a side elevational view of a grooved forming shoe of this invention showing each groove extending from a beginning in the nose of the forming shoe to the end of the forming shoe.
Figure 2:
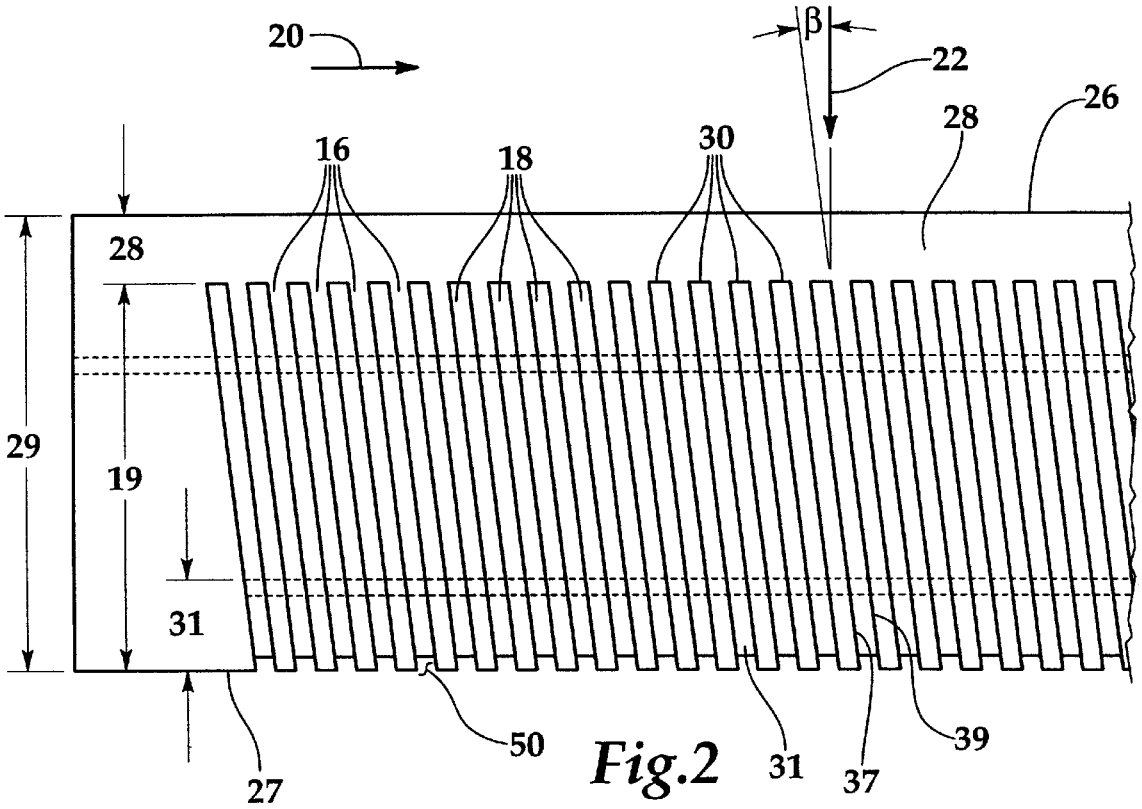
FIG. 2 is a plan view of the forming shoe shown in FIG. 1 and showing the plurality of slots extending parallel to each other from their beginning the nose downstream in the face surface of the forming shoe.

With reference to FIGS. 1 and 2, a forming shoe, designated generally by the number 10, has a body 24 which includes a T-shaped slot 12 for slideably engaging a mounting bracket in the forming section of a papermaking machine. The top of the forming shoe has a face surface 14 which comprises a plurality of land areas 16 which define a plurality of parallel grooves 18, which land areas and grooves extend side by side in substantially parallel alignment across the effective width of the forming shoe in the direction of the arrow 20.

The grooves extend longitudinally in the face of the forming shoe across the face surface 14 substantially, but not exactly, in the direction of the arrow 22. Since arrow 22 represents the direction of forming wire travel, the grooves do not extend parallel with arrow 22, but at a small angle with respect to it. Each of the grooves is substantially identical with the other grooves, so separate ones will not be individually designated.

In the parlance of the papermaking industry, the machine direction is the direction from the forming section, where the aqueous slurry of wood pulp fibers (commonly called stock) begins its formation into a paper web, to the reel, where the dry paper web is wound onto a spool for further processing, such as being wound into a uniform roll to be used in a printing operation. Thus, the forming wire or wires, on which the stock is deposited to begin the paper web forming process, travel in the machine direction, as designated by arrow 22.

In accordance with this definition, upstream is the direction toward the headbox (wet end) and downstream is in the direction of forming wire travel toward the reel (dry end).

The cross-machine direction, by similar reasoning, is the direction across the width of the papermaking machine which extends perpendicular, or at right angles, to the machine direction.

The forming shoe has a body 24 which extends longitudinally with co-extending leading and trailing edges 26, 27, respectively, which are arranged perpendicular to the machine direction, as shown FIG. 2, when the forming shoe is in operating position.

The face surface of the forming shoe body has a nose 28 which is curved. When the forming shoe is in operating position, the nose portion of the face surface is disposed to curve downwardly in the upstream direction relative to the remainder of the face surface. The surface of the nose nearest the leading edge 26 is smooth, continuous, without grooves and impervious to the passage of water therethrough.

The nose portion 28 of the face surface 14 preferably has a smaller radius 15 than the radius 17 downstream portion of the face surface. For example, the surface of the shoe is formed by a curve having a compound radius. On a shoe having a face surface extending eighteen inches wide in the machine direction, the first four inches of the nose, for example, might have a radius of about 30–40 inches (76.2–101.6 cm), the next twelve inches of the face surface having a radius of about 100 inches (254 cm) and the trailing two inches or so of the shoe might, for example, have a radius in the range of about 150–200 inches (381–508 cm).

If the rate of water removal from the web is to be enhanced in a porous trailing portion, the radius of curvature becomes smaller again relative to the radius of curvature of the intermediate portion. If the nose 28 is a simple, continuous curve, the remainder of the face downstream of the nose portion could comprise a curve having a much larger radius which might, for example, approach 200 inches (508 cm).

Similarly, the curvature of the porous portion face surface might comprise two or more radii starting with the nose portion 28. The radii then might be initially about 30–40 inches (76.2–101.6 cm), then increase to about 100 inches (254 cm), and end at about 200 inches (508 cm), for example (FIG. 9A).

If a simple, continuous radius is used for the nose and the face surface of the shoe (FIG. 9), such a radius might be about 100–200 inches, for example. It is contemplated that the radius of curvature could change continuously along the face surface of the forming shoe to enhance water removal.

The overall face width 29 of the shoe (i.e., the distance in the machine direction when the shoe is in operating position) in a preferred embodiment is about 15–18 inches. This provides ample room for configurations which use two or more radii over the face surface extending from the nose portion 28 to the trailing portion 31. The face surface along its width is divided into a non-porous nose portion 28, an intermediate porous portion 19, and a trailing portion 31.

Figure 4:
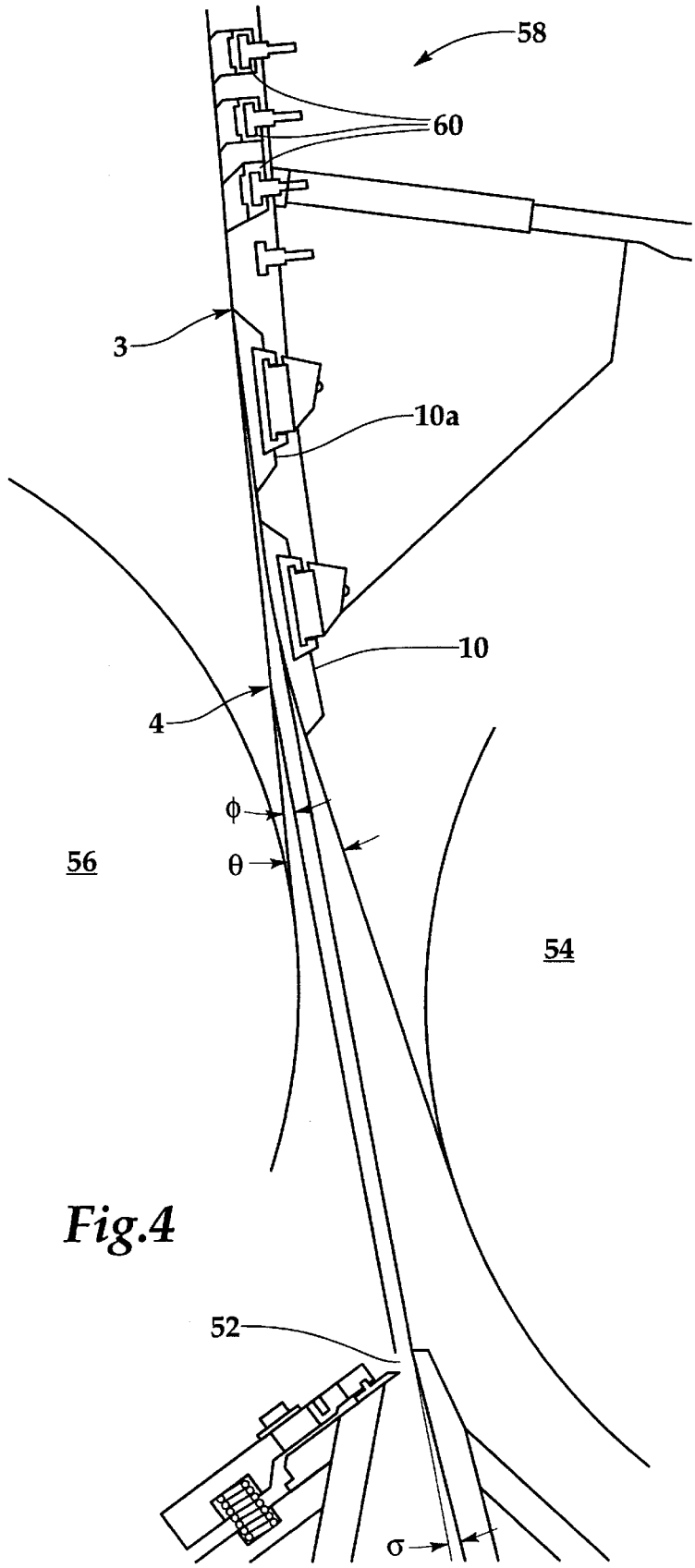
FIG. 4 is another side elevational view of a forming shoe and headbox with a nozzle for projecting a stream of stock over the forming shoe similar to that shown in FIG. 3, but in a substantially vertical direction.
Figure 5:
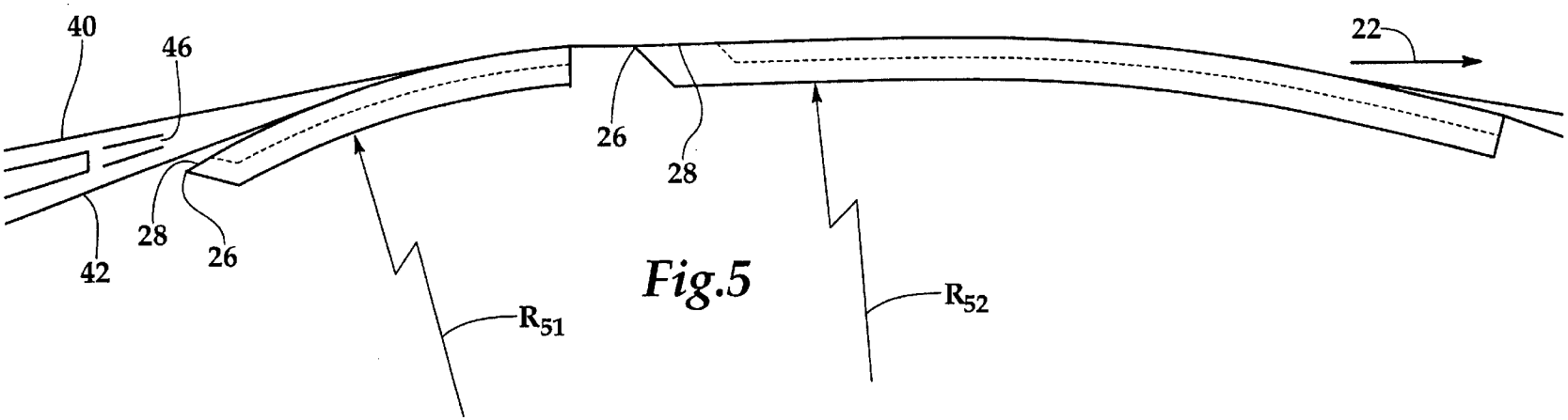
FIG. 5 is a side elevational view of a pair of grooved forming shoes, the leading shoe having a smaller radius of curvature of its face surface than that of the trailing shoe.

In the embodiment wherein two forming shoes are used in tandem array, such as shown in FIGS. 4 and 5, the forming shoe might comprise a pair of shoes or blades, each blade having a face surface width of between about 5–8 inches, with a span, such as about 0.5–4.0 inches, for example, between shoe or blade segments. In such an embodiment, the first (leading) shoe/blade would have a single radius of curvature in the range of about 30–60 inches. This radius could be a compound radius. The second (trailing) shoe/blade would have a single radius of curvature in the range of about 100–200 inches.

In this invention, the term "porous" is used to describe the intermediate and trailing portions of the face surface of the forming shoe which are grooved or have openings for accepting water from the stock through the contiguous forming wire. Such openings can take the form of holes, slots, honeycomb structures, or the like. Depending on whether the porous capability is provided by a groove or an opening, the water is either directed out via the open end (groove) or through the forming shoe (openings).

As shown in FIGS. 1 and 2, each of the grooves has a front intersection 30 which smoothly forms the transition between the substantially straight bottom surface 32 of the groove and the location where the bottom surface 32 intersects the downwardly curved, non-porous nose surface. Therefore, a portion of the groove extending into the downwardly curved nose portion of the upper, face surface toward the leading edge 26 is less deep than the downstream portion of the groove. However, if a higher vacuum is desired at the beginning of a groove, it is contemplated that the beginning of the groove begin abruptly. This permits the whole shoe to be rotated in its mounting to control the rate of dewatering by controlling the amount of water which can enter the grooves at a particular location on the shoe. Such gradual depending of the groove in the downstream direction also accommodates additional water entering the groove without overflowing the grooves.

In a curved face surface, it is contemplated that the maximum depth of the grooves might be in the center or middle of the forming shoe, in the machine direction.

Figure 1A:
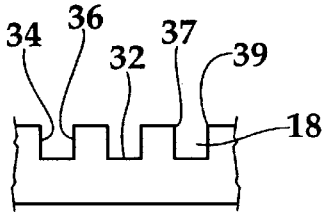
FIG. 1A is an end elevational view of the forming shoe along lines A—A in FIG. 1, showing the grooves in more detail.

The face surface for the working width of the forming shoe extending in the cross-machine direction when the forming shoe is in operating position, extends laterally in the cross-machine direction along the longitudinal length of the shoe beneath the forming wire. Each groove is defined by a bottom surface 32 and two, parallel side surfaces 34, 36 (FIG. 1A), which end in upper edges 37, 39, all of which extend substantially in the machine direction, but at a small angle, such as between about 2°–20° in a preferred embodiment, to the machine direction as shown by angle $\beta$ in FIG. 2. In a preferred embodiment, the bottom surface 32 is straight (while increasing in depth), but it is contemplated that it could be curved. As shown in FIG. 2, the working width of the forming shoe extends substantially over the surface of the forming shoe to the right of arrow 38 to a similar point on the right side of the forming shoe, which is not shown.

With further respect to FIGS. 1 and 2, in operating position, the forming shoe is mounted in the papermaking machine such that its leading and trailing edges 26, 27, respectively, extend in the cross-machine direction along the length of the forming shoe. The forming shoe is therefore mounted such that its longitudinal length extends in the direction of the width of the papermaking machine in the cross-machine direction.

The plurality of grooves, by the same convention, therefore extend substantially along the width of the forming shoe, and this forming shoe width in turn extends in the machine-direction of the papermaking machine.

Figure 3:
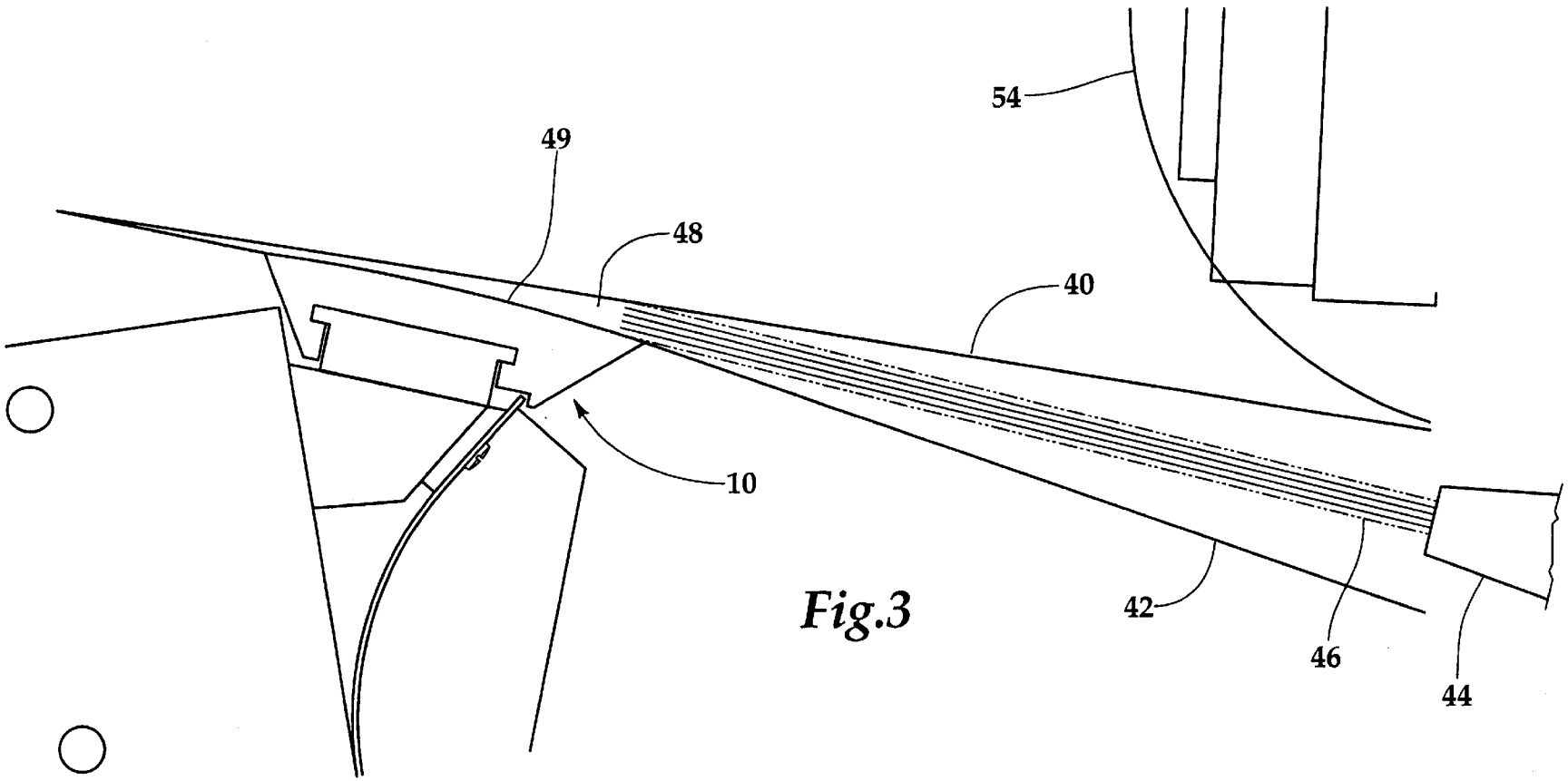
FIG. 3 is a side elevational view of a forming shoe in this invention in conjunction with a headbox nozzle for projecting a stock stream between two co-running forming wires converging over the forming shoe.

With reference to FIG. 3, a two-wire web forming arrangement is shown which utilizes the forming shoe of this invention. In this arrangement, top and bottom forming wires 40, 42, respectively, are guided to run in co-running convergence over the forming shoe 10. The lower forming wire 40 is guided over the entire face surface of the forming shoe, including the nose 28. The top forming wire comes into convergence with the bottom forming wire further downstream over the porous portion of the face surface.

A nozzle 44 from a headbox (not shown) projects a stock stream 46 into the converging area 48 between the forming wires over the porous or non-porous portion of face surface of the forming shoe. Some headboxes utilize an opening 52, called a slice (FIG. 4) which is analogous to a nozzle, such as nozzle 44, for projecting a stock stream. The stock stream has a width of a 0.42 inches as shown in FIG. 4. This convergence urges and facilitates drainage of water from the stock into the grooves 18 in a gentle manner over the relatively long width of the forming shoe. The point of impingement 49 of the stock stream onto the lower forming wire 42, or between forming wires 40, 42, is preferably over the porous portion (i.e., grooved as shown in FIG. 3) of the forming shoe face surface. However, it is contemplated that the point of stock stream impingement could be over the non-porous nose portion. The rate of water drainage through the bottom forming wire is controlled by the open, porous face area and cross-sectional area of the individual grooves as well as the fact that there is no drainage through the forming shoe, either by means of passageways open to atmospheric pressure beneath the forming shoe, or by means of the application of sub-atmospheric pressure (i.e., vacuum) to any such passageways through the shoe.

Instead, the water is removed at the trailing edge 27 of the forming shoe via the open ends 50 of the grooves, shown in FIG. 2.

Depending on the attitude of the forming shoe relative to the plane of the traveling forming wire(s), the diverging grooves can generate a vacuum if they contain even a small amount of water as the water is evacuated. The amount of vacuum would depend on such factors as machine speed, groove depth and groove angle. The vacuum also is a function of the rate of water drainage. Accordingly, the depth of the grooves increases in the downstream direction to both accommodate additional water while providing sufficient open volume to create a slight vacuum in each groove.

FIG. 4 shows a two-wire forming arrangement similar to that shown in FIG. 3, but utilizing two forming shoes in tandem. FIG. 4 also shows the headbox slice opening 52 and wire turning rolls 54, 56 for guiding the top and bottom forming wires into convergence over the porous portion of the leading forming shoe. In this case, the porous feature is provided by grooves in the face surface of each shoe. Downstream of the forming shoes is a curved dewatering section 58 comprising a plurality of foils 60 which are arrayed to define a long-radius curved path of travel of the forming wires with the nascent paper web sandwiched in between to further dewater the paper web in a gentle manner. In FIG. 4 the width of the stock jet is 0.42 inches and the jet makes an angle $\sigma$ of approximately 3.3 degrees with the bottom of a slice slip. The angle $\phi$ is 4.4 degrees, and the angle $\theta$ is 12.2 deg. The Fabric Separation Point is indicated by 3 and the Trapping Point is indicated by 4.

Finally, in FIG. 4, the second forming shoe 10*a,* which is downstream of the initial forming shoe 10, can also be equipped with openings other than grooves as shown and described above. It is contemplated that two or more forming shoes can be used in a shoe-segment configuration to form a forming section having a compound radius comprising more than two radii to provide or promote certain desired drainage conditions consistent with the desired degree of paper mat formation at a selected machine-direction position. Such a configuration is shown in FIG. 5 wherein $R_{51}$ could be about 30–40 inches and $R_{52}$ could be about 150–200 inches.

While two-wire paper web forming arrangements have been shown in FIGS. 3 and 4, it is contemplated that the invention could be applied to single wire web forming arrangements in much the same manner as described in conjunction with the two-wire forming arrangements. The single wire forming arrangement would be more horizontally arranged to maintain the stock on the forming wire during the dewatering process. In a single wire arrangement, the porous surface in a groove shoe embodiment would take the form of the grooves being formed in a substantially flat surface. On such an arrangement, the point of stock stream impingement would be on or before the tip.

In operation, with reference to FIGS. 2 and 3, as the forming wire(s) on or between which the stock is being projected travels beyond the beginning of a groove at the intersection 30 between the bottom surface of a groove and the surface of the nose, water expressed through the lower forming wire enters the grooves. Initially, at least the forming wire 42 momentarily passes over the non-foraminous, or smooth, leading surface of the nose, the water drains from the stock into the interstices of the forming wire. As the forming wire passes over the smooth intersection 30 of the bottom surface of a groove, the water very gently begins to pass out of the forming wire into the initial, relatively shallow portion of the groove as the forming wire is guided over the face of the forming shoe.

The depth of the grooves 18 increase gradually (smoothly) downstream of the nose 28, in a preferred embodiment, to accommodate more water gently draining through the lower surface of the forming wire 42 on the forming shoe as the forming wires pass downstream. The water is discharged out the open end 50 of the back end 31 of the each groove.

Since the grooves extend at a small angle, which in a preferred embodiment range from about 2° to about 20°, still more preferably 6°, to the direction of wire travel, the upper edges 37, 39 of the grooves intercept the inner surface of the looped forming wire at this same small angle so as to gently urge water from the lower, inner surface of the looped forming wire into the groove for removal.

Further, in a preferred embodiment, the groove depth (more exactly, the exit groove depth) is about 0.05–0.75 inch, preferably 0.20 inch, the groove width is about 0.0625–0.75 inch, preferably, 0.25 inch, but it is contemplated that small differences in these parameters could be made without departing from the spirit or scope of the attached claims. Also, in a preferred embodiment, the land width in the face surface of the shoe is equal to the groove width. However, the land and groove widths need not be equal. For example, the groove width could be larger than the land width.

In a preferred embodiment, the beginning of each groove, designated as the intersection 30, in conjunction with the low angle and the length of the groove across the width of the forming shoe, are such that a particular point of location on the lower surface of the forming wire passing over an intersection 30 (i.e., beginning) of a groove in the nose surface will also pass over a trailing location 31 (FIG. 2) of an adjacent groove. However, it is contemplated that, depending on the operating parameters, such as machine speed, groove width and depth, such a particular point on the inner side of the looped forming wire could pass over the trailing portion of a non-adjacent groove, such as a groove once removed from an adjacent groove. In such a case, the traveling point would pass over two or more grooves in its travel over the porous portion of the forming shoe face surface.

The impingement point 49 of the stock stream from the headbox is beyond the intersection 30 of the beginning of the grooves in the nose surface. The groove arrangement in the nose portion and entire face surface of the forming shoe improves the interaction of the stock impingement onto the forming shoe with the water removal process to improve formation of the paper web at the earliest stage of formation.

Figure 6:
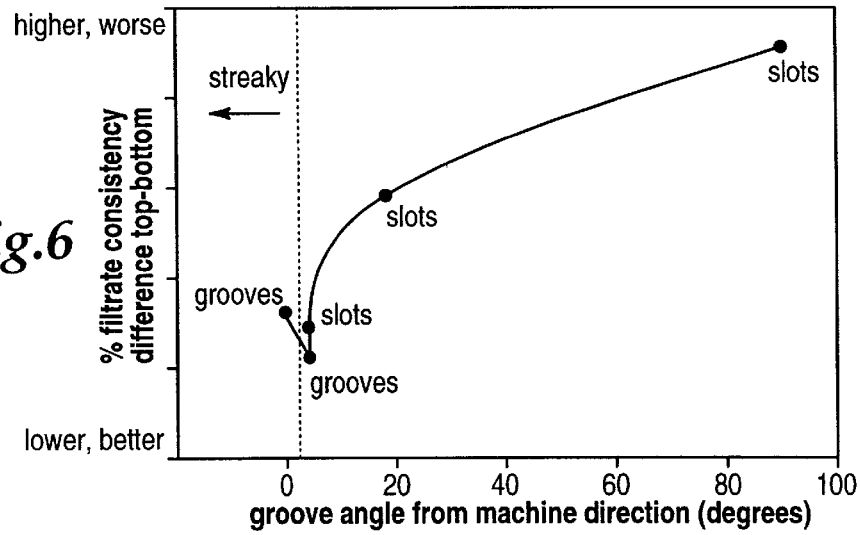
FIG. 6 is a chart showing groove angle, relative to machine direction, measured against percent filtrate consistency.

With reference to FIG. 6, a graph plotting the groove angle from the machine direction in degrees is plotted against the percent of filtrate consistency measured from the top of the paper sheet produced to the bottom. In this regard, the smaller the percent consistency difference, the better the quality of the paper sheet produced is through the entire sheet. As indicated in FIG. 6, at a groove angle below about 2°, the sheet tends to become more streaky than is acceptable for quality purposes. Between about 2° to about 20°, the percent filtrate consistency is acceptable for a quality paper sheet. At a groove angle of about 6°, the optimal percent filtrate consistency throughout the paper sheet produced is achieved.

Figure 7:
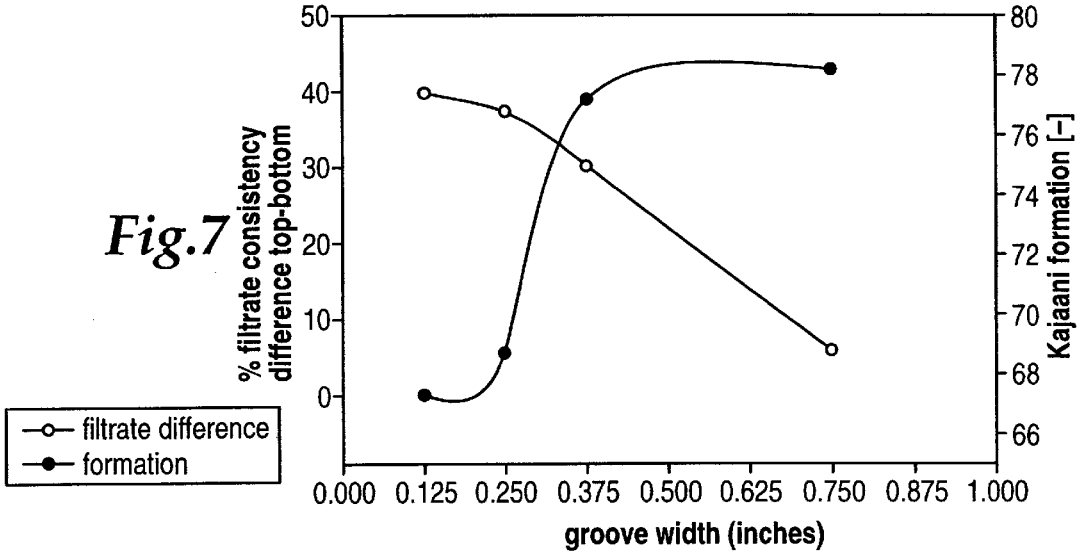
FIG. 7 is a chart showing groove width measured against percent filtrate consistency.

Referring to FIG. 7, the groove width is plotted against the percent filtrate consistency difference from the top to the bottom of the paper sheet produced (left ordinate), and against the formation of the paper sheet produced as measured by the Kajaani formation method. As shown, the optimal combination of filtrate difference and formation of the web sheet produced is achieved at a groove width ranging from about 0.125 inch to about 0.375 inch.

Figure 8:
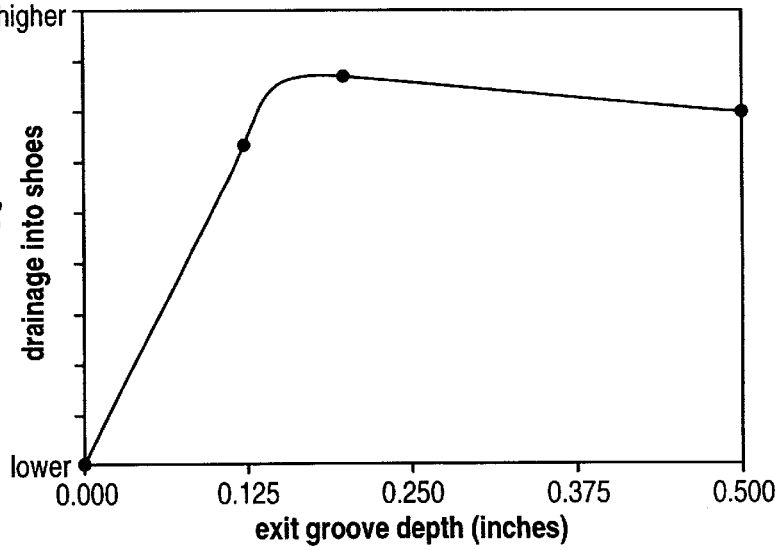
FIG. 8 is a chart showing exit groove depth measured against water drainage.

With reference to FIG. 8, the groove depth is plotted against the drainage of water into the grooves beneath the forming wires. The higher the amount of drainage of water to the grooves, the better. As shown in this chart, the optimum groove depth is attained at a groove depth from about 0.125 inch to about 0.50 inch.

FIGS. 9, 9A, 10, 11A–C, and 12 relate to another embodiment of this invention wherein the porous portion of the face surface of the forming shoe comprises a plurality of openings, such as drilled holes, small slots, honeycomb perforations, and the like, to permit water expressed through the adjacent forming wire to travel through the forming shoe in a controlled manner for removal from the papermaking apparatus.

Figure 9:
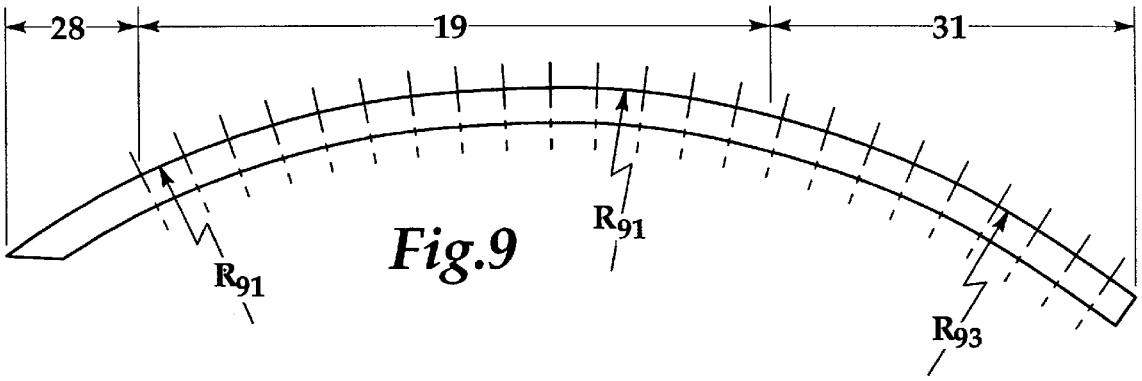
FIG. 9 is a side elevational view of a forming shoe having a curved face surface with a single radius of curvature, with the surface having a plurality of holes extending through the forming shoe.
Figure 9A:
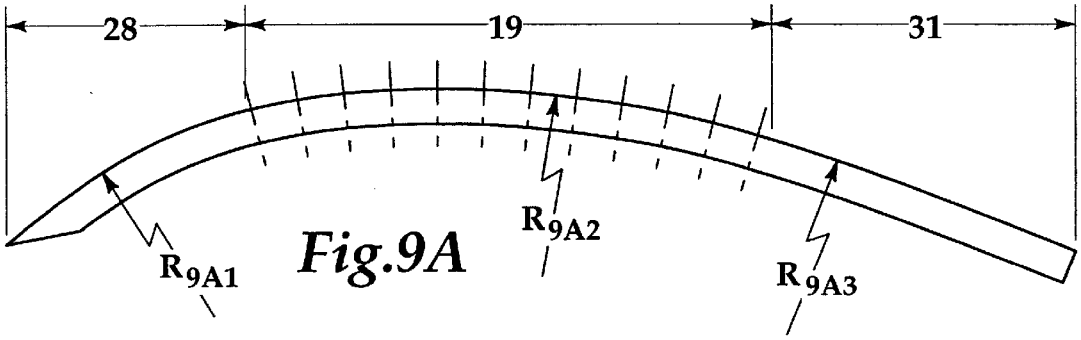
FIG. 9A is a side elevational view of a forming shoe having a curved face surface with the curvature constantly changing along its length in the machine direction from smaller to larger radii.

With reference to FIGS. 9 and 9A, FIG. 9 shows a forming shoe having a face surface 14 with a porous portion 19 extending downstream from the nose portion 28 to the end of the trailing portion 21. The trailing portion, with reference to FIGS. 2 and 9A, can be porous or non-porous, as desired. In FIG. 9, the radius of curvature of the nose portion 28 is $R_{91}$; the radius of curvature of the intermediate porous portion 19 is $R_{92}$; the radius of curvature of the trailing portion 21 is $R_{93}$, are all the same radius.

In FIG. 9A, the corresponding radii of curvature of the nose portion 28, intermediate (porous) portion 19, and the trailing (non-porous) portion 21, are different and vary continuously along their arcuate surfaces. This is analogous to a French curve to the extent that $R_{9A1}$, $R_{9A2}$ and $R_{9A3}$ vary from small to large, respectively. The concept here is that the rate of water removal can be controlled as a function of other parameters, such as machine speed, stock consistency and the paper product desired.

Figure 9B:
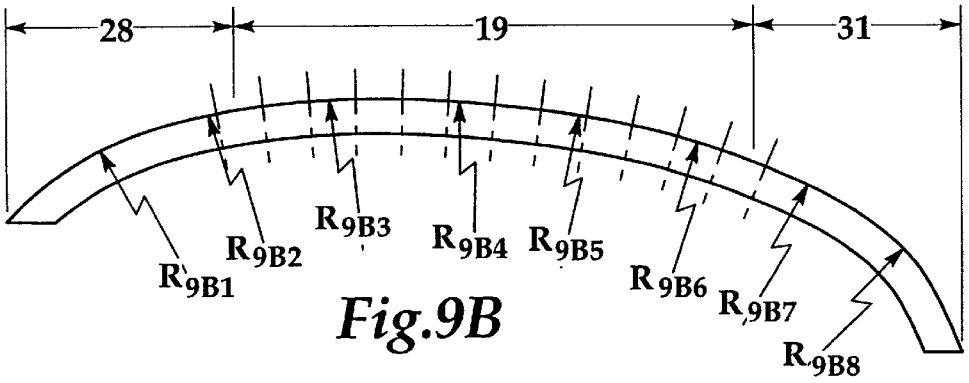
FIG. 9B is a side elevational view of a forming shoe having a curved face surface where the curvature constantly changes along its length.

In FIG. 9B, the face surface of the forming shoe constantly changes from a small radius R (30 inches–40 inches) to a larger radius R (100 inches–200 inches) and then back to a small, decreasing R (10 inches). This is shown by the plurality of radii ranging from $R_{9B1}$ to $R_{9B8}$.

Figure 10:
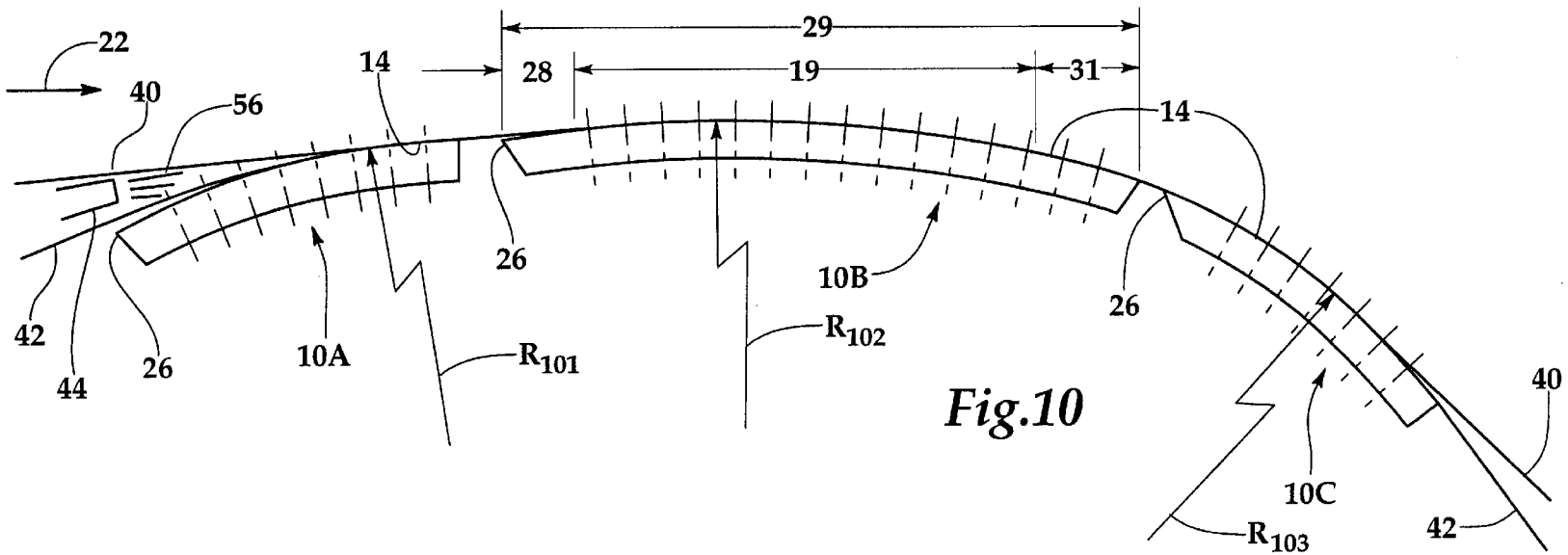
FIG. 10 is a side elevational view of a forming shoe apparatus comprising three forming shoes in tandem.

With reference to FIG. 10, a forming shoe apparatus is shown wherein the shoe dewatering function is provided by three separate forming shoes 10A, 10B and 10C mounted in tandem. As in all of the embodiments, the forming wire, or wires 40, 42, are brought into contact with the porous portion 19 of the face surface 14 on the lead forming shoe such that the water is immediately drained through the porous face surface as the stock stream 46 is projected from the headbox nozzle 46, or headbox slice 52.

Figure 11A:
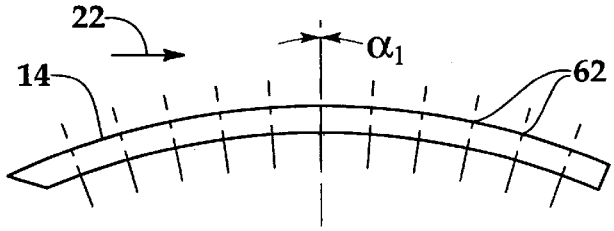
FIGS. 11A, B, C are side elevational views of an embodiment of a forming shoe of this invention wherein the porous surface comprises a plurality of holes.
Figure 11B:
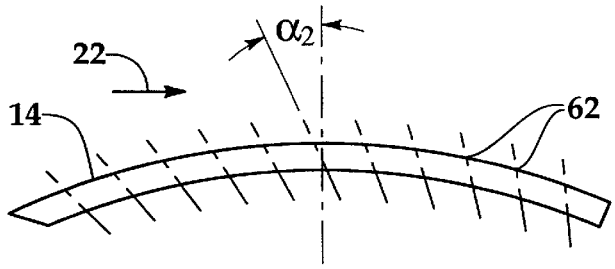
Figure 11C:
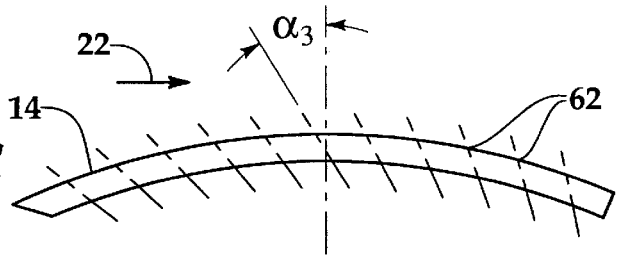

The radius of curvature of the face surface 14 of the leading forming shoe 10A is $R_{101}$. The radius of curvature of the face surface of the second forming shoe 10B, in the machine direction shown by arrow 22 is $R_{102}$. Similarly, the radius of curvature of the third forming shoe 10C is $R_{103}$. In a preferred embodiment, radius $R_{101}$ is between about 30–60 inches. Radius $R_{102}$ is about 150–200 inches. Radius $R_{103}$ at its ending is about 10 inches, or less. Radius R could change continuously in a smooth manner similar to a French curve. In FIGS. 11A, B and C, the openings 62 forming the porous portion of the face surface of the forming shoes can be arrayed at different angles $\alpha_1$, $\alpha_2$, and $\alpha_3$, for example, such that they are angled forwardly against the direction of travel to change the manner in which they accept water therethrough for drainage from the forming apparatus. Thus, $\alpha_1$ represents holes formed with their central axes _64 normal to a tangent plane where the central axes enters the forming shoe. In a similar manner, angle $\alpha_2$ might be about 22½° from a central axis to a line perpendicular to a plane tangent at the location of the hole on the face surface, and angle $\alpha_3$ might be 45°, for example, between a central axis line to a line perpendicular to a tangent plane where a hole enters the face surface.

Figure 12:
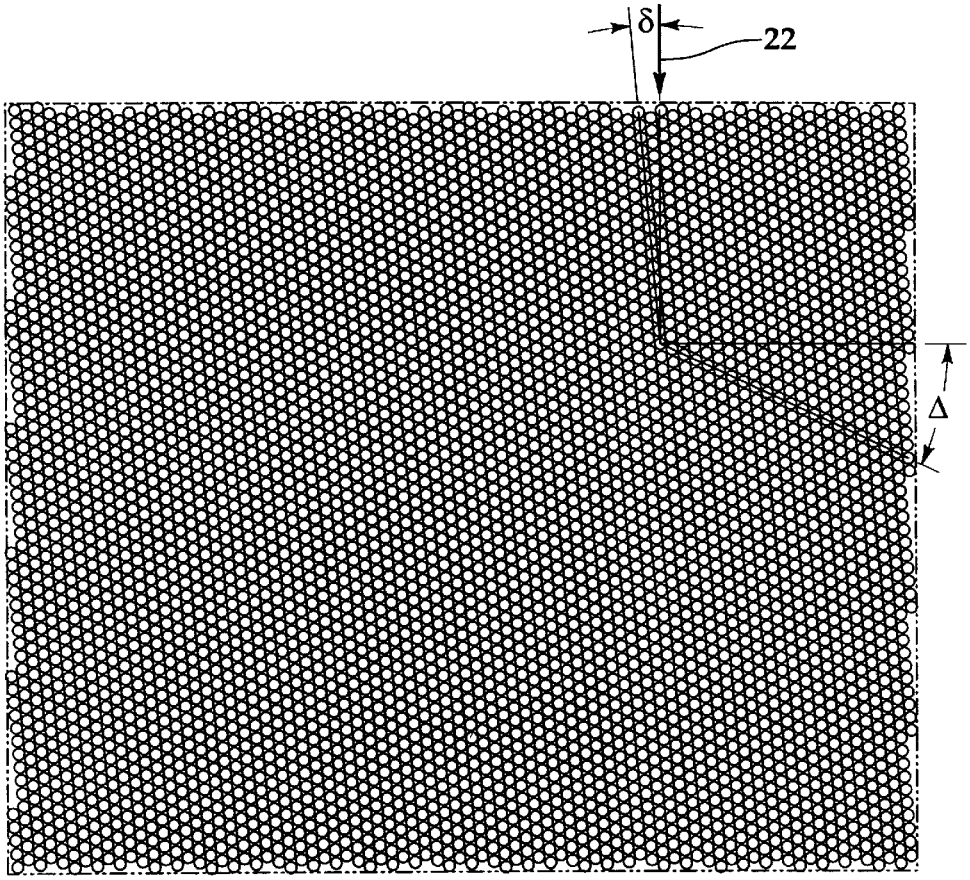
FIG. 12 is a plan view of a forming shoe, such as is shown in FIG. 11A–C, and showing the holes in the face surface.

FIG. 12 shows, in plan view of, the uniformity of an embodiment wherein the porous feature (i.e., opening 62) is provided by holes, such as drilled holes in the intermediate portion, and possibly also the trailing portion of the forming shoe. The interstices in the foraminous area of the face surface of the forming shoe permits water to be passed through the shoe in a relatively gentle manner, due to the small size of the individual interstices (i.e. drilled holes having a diameter of about 0.30 inch, for example). This permits control of the rate of water removal. In FIG. 12 the angle $\delta$ is 5.1207 degrees and the angle $\Delta$ is 24.05677 degrees. The wiped direction is indicated by the arrow 22 and the distance between the center of holes which lie in rows at a small angle to the wiped direction is typically 0.293 inches. The distance between the center of holes which lie in rows of approximately perpendicular to the wipe direction is typically 0.3270 inches.

In the embodiments wherein the porous feature is provided by openings, such as holes, and with particular reference to the three-shoe forming apparatus shown in FIG. 10, in a preferred embodiment, the radii of curvature $R_{101}$, $R_{102}$, $R_{103}$ of the face surface are different to allow different rates of drainage of the water at different locations along the porous surface, or surfaces, and to influence the rate of water drainage so as to provide a uniform or substantially constant rate of water drainage at different locations along the path of travel, as desired. Thus, with reference to FIG. 10, the third forming shoe $R_{103}$ has a small radius of curvature of the face surface to provide increased pressure against the nascent paper web since the pressure is an inverse function of the radius as well as a direct function of the tension of the forming wire, or wires. Since the paper web has been dewatered more by the time it reaches the third forming shoe, greater pressure is required to maintain the same, or greater, pressure to effect the dewatering function to maintain the rate of water drainage substantially constant, or near constant as desired. The different radii in the multiple-shoe forming arrangement permits the rate of water drainage to be optimized and increased while maintaining, or improving, web formation at increased machine speeds.

However, with further reference to FIG. 10, the radii $R_{101}$, $R_{102}$, and $R_{103}$ it is contemplated that each of these radii could vary continuously in the manner shown and described with respect to FIG. 9B.

While in the preferred embodiment, the leading edge of the forming shoe extends in the cross-machine direction at right angles to the machine direction, it is contemplated that the small angle at which it is desired to align the grooves relative to the machine direction/direction of forming wire travel can be effected by skewing the entire forming shoe slightly such that the grooves could extend at right angles to the leading edge and still be arrayed in the papermaking machine at the desired small angle to provide the desired gentle dewatering action. In this regard, the concept is to provide a more gentle dewatering at a high machine speed by arraying the grooves at a small angle to the machine direction. Whether this is done by making the grooves extend at a small angle to the leading edge in the forming shoe, and then arraying the forming shoe in operating position with the leading edge extending in a cross-machine direction, or by making the grooves extend perpendicular to the leading edge and then skewing the entire forming shoe at a small angle to the cross-machine direction, or some combination of both of these, such arrangements for providing the small angle of the grooves are also contemplated and considered to be within the scope of the invention.

What is claimed is:

1. Apparatus for the formation of a paper web from stock in a papermaking machine, the apparatus having at least two looped forming wire having inner and outer surfaces for travel in the direction of paper web formation, comprising:

a headbox, forming a jet of stock for depositing stock onto the outer surfaces of the two forming wires to travel in a machine direction downstream thereon;

a forming shoe means mounted in the apparatus within one of said two forming wires, the forming shoe means comprising at least one forming shoe having a leading edge and a face surface for engaging the said one forming wire, and over which said jet impinges, wherein, the at least one forming shoe has a multiplicity of grooves formed in the face surface which do not extend to the leading edge, and do not extend through the shoe, the grooves being positioned at an angle of 2 to about 20 degrees to the machine direction, as they extend to a trailing edge of the shoe, and the depth of the grooves gradually increasing from the point at which they start to the trailing edge, the face surface of the shoe along which the one wire travels having a convex curvature as the shoe extends in the machine direction.

2. The apparatus of claim 1 wherein the grooves are positioned at an angle of about six degrees of the machine direction, as they extend to a trailing edge of the shoe.

3. The apparatus of claim 1 wherein the location of the jet of stock impingement is over the grooves formed in the face of the at least one forming shoe.

4. The apparatus of claim 1 wherein the grooves begin substantially flush with a nose surface and gradually increase in depth as they extend in the downstream direction toward the trailing edge.

5. The apparatus of claim 1 wherein the grooves are angled by angling the shoe with respect to the cross machine direction.

6. The apparatus of claim 4 wherein the groove depth is in the range of from about 0.05 inches to about 0.75 inches, and the groove width is in the range of from about 0.125 inches to about 0.75 inches.

7. The apparatus of claim 4 wherein the groove depth is about 0.2 inches, and the groove width is about 0.24 inches.

8. The apparatus of claim 4, wherein:

the grooves extend downstream from a point in the nose surface downstream from the leading edge;

the grooves extend downstream at an angle to the machine direction of about 6 degrees; and the groove depth is about 0.20 inch, and the groove width and the width of lands between the grooves is about 0.25 inch.

9. The apparatus of claim 1, wherein the grooves are substantially parallel with one another.

10. The apparatus of claim 1, wherein the grooves extend at an angle to the machine direction such that, over the distance of the shoe face, the beginning of each groove overlaps the ending of at least one adjacent groove, when moving along a line extending in the machine direction.

11. The apparatus of claim 1, wherein:

the face surface, of the at least one forming shoe has a continuously changing radius from its leading edge to its trailing edge; and the changing radius varies from about 76–100 cm in the nose portion, increases to about 2.5–5 meters in an intermediate portion, and decreases to about 25 cm in a trailing portion.

12. The apparatus of claim 1, further comprising at least two shoes arranged in the machine direction with varying radiuses of curvature.

13. An apparatus for the formation of a paper web from stock in a papermaking machine, the apparatus having at least two looped foming wires having inner and outer surfaces for travel in the direction of paper web formation, a headbox, forming a jet of stock for depositing stock onto the outer surfaces of the two forming wires to travel in a machine direction downstream thereon;

a forming shoe means mounted in the apparatus within one of said forming wires, the forming shoe means comprising at least one forming shoe having a leading edge and a face surface for engaging the said one forming wire, and over which said jet impinges;

wherein the improvement comprises a multiplicity of holes formed in the shoe, each hole having a central axis which is angled upstream towards the headbox, wherein an angle $\alpha$ is defined between the central axis of each hole and a line perpendicular to a plane tangent at the location of said hole on the face surface, wherein the angle $\alpha$ is between about 22½ degrees and 45 degrees, and wherein the upper surface of the shoe along which the one wire travels having a convex curvature as the shoe extends in the machine direction.

14. The apparatus of claim 13 wherein the holes have a diameter of about 0.30 inches.

* * * * *